US006896045B2

(12) United States Patent
Panek

(10) Patent No.: US 6,896,045 B2
(45) Date of Patent: May 24, 2005

(54) STRUCTURE AND METHOD OF ATTACHING A HEAT TRANSFER PART HAVING A COMPRESSIBLE INTERFACE

(75) Inventor: Jeffrey Panek, North Kingstown, RI (US)

(73) Assignee: Cool Shield, Inc., Warwick, RI (US)

( * ) Notice: Subject to any disclaimer, the term of this patent is extended or adjusted under 35 U.S.C. 154(b) by 17 days.

(21) Appl. No.: 10/277,948

(22) Filed: Oct. 21, 2002

(65) Prior Publication Data

US 2003/0075312 A1 Apr. 24, 2003

Related U.S. Application Data

(60) Provisional application No. 60/335,064, filed on Oct. 24, 2001.

(51) Int. Cl.[7] ..... H05K 7/20

(52) U.S. Cl. ..... 165/185; 165/80.3; 29/890.03; 361/704

(58) Field of Search ..... 165/80.3, 185; 174/16.3; 257/722; 361/704; 29/890.03

(56) References Cited

U.S. PATENT DOCUMENTS

| | | | | | |
|---|---|---|---|---|---|
| 4,938,279 | A | | 7/1990 | Betker | 165/46 |
| 4,999,741 | A | * | 3/1991 | Tyler | 165/185 |
| 5,046,415 | A | * | 9/1991 | Oates | 101/128.21 |
| 5,315,480 | A | | 5/1994 | Samarov et al. | 361/705 |
| 5,440,172 | A | | 8/1995 | Sutrina | 257/712 |
| 5,572,070 | A | | 11/1996 | Ross | 257/713 |
| 5,660,917 | A | | 8/1997 | Fujimori et al. | 428/195 |
| 5,667,884 | A | * | 9/1997 | Bolger | 428/323 |
| 5,738,936 | A | | 4/1998 | Hanrahan | 428/313.5 |
| 5,781,412 | A | | 7/1998 | de Sorgo | 361/704 |
| 5,922,783 | A | | 7/1999 | Wojciak | 522/18 |
| 5,968,606 | A | | 10/1999 | Osuna et al. | 427/510 |
| 5,970,319 | A | * | 10/1999 | Banks et al. | 438/115 |
| 6,046,907 | A | * | 4/2000 | Yamaguchi | 361/704 |
| 6,204,303 | B1 | | 3/2001 | Osuna et al. | 522/71 |
| 6,292,362 | B1 | * | 9/2001 | O'Neal et al. | 165/80.3 |
| 6,294,408 | B1 | * | 9/2001 | Edwards et al. | 438/121 |
| 6,315,038 | B1 | * | 11/2001 | Chiu | 165/185 |
| 6,335,862 | B1 | * | 1/2002 | Koya | 361/720 |
| 6,409,859 | B1 | * | 6/2002 | Chung | 156/69 |
| 6,535,388 | B1 | * | 3/2003 | Garcia | 361/704 |
| 6,608,380 | B2 | * | 8/2003 | Ro et al. | 257/712 |
| 6,617,683 | B2 | * | 9/2003 | Lebonheur et al. | 257/707 |
| 2001/0026441 | A1 | * | 10/2001 | Nakamura | 361/720 |
| 2002/0086600 | A1 | * | 7/2002 | Ghosh | 442/229 |
| 2003/0058620 | A1 | * | 3/2003 | Rumer et al. | 361/705 |

* cited by examiner

*Primary Examiner*—Leonard R. Leo
(74) *Attorney, Agent, or Firm*—Barlow, Josephs & Holmes, Ltd.

(57) ABSTRACT

The present invention discloses a thermal transfer interface having an integrally formed means for fastening and maintaining intimate thermal contact between a heat generating device and a heat-dissipating device. The interface of the present invention includes two components, a compressible thermal transfer component having a first thickness and an adhesive fastening component having a second thickness that is less than the first. The first component, the thermal transfer element, includes a base polymer matrix compound that is loaded with a thermally conducting filler that imparts thermally conductive properties to the net shape moldable material. The polymer base matrix is preferably a highly compressible material such as an elastomer. The second component of the present invention is a pressure sensitive adhesive component. The adhesive is applied adjacent to the thermal transfer element or in an alternating pattern throughout a base field of thermal transfer material. The adhesive component has a thickness that is less than the overall thickness of the thermal transfer material. When, the heat dissipating device with the present invention applied is pressed into contact with a heat generating surface the elastomer is compressed and maintained in the compressed state by the pressure sensitive adhesive material.

17 Claims, 2 Drawing Sheets

STRUCTURE AND METHOD OF ATTACHING A HEAT TRANSFER PART HAVING A COMPRESSIBLE INTERFACE

CROSS-REFERENCE TO RELATED APPLICATIONS

This application is related to and claims priority from earlier filed provisional patent application No. 60/335,064 filed Oct. 24, 2001.

BACKGROUND OF THE INVENTION

The present invention relates generally to an elastomeric material composition for use in joining heat-dissipating devices with heat generating electronic devices and a method for manufacturing the same. More particularly, this invention relates to a new compressible thermal interface assembly having an integral interface and fastening means that is applied directly to the heat dissipation device at the time of manufacture. The present invention includes a interface composition that contains thermally conductive filler material in a conformable elastomeric matrix and an integral means for adhering the heat dissipation device to a heat-generating surface thereby compressing the interface composition to form an improved heat sink device with an integral, compressible thermally conductive interface layer. Further, a method of manufacturing the device is also provided.

In the prior art, it is well known that the most critical locations that effect the overall performance of a heat transfer assembly are the interface points. These locations are where two different materials mate to one another introducing two contact surfaces and often an air gap across which the heat being dissipated must be transferred. Generally, the contact surfaces are not always perfectly flat due to milling or manufacturing tolerances thus creating small and irregular gaps between the heat generating surface and the heat dissipating devices thereby increasing the thermal resistance of the overall assembly. These imperfections and gaps between the mating surfaces often contain small pockets of air that can significantly reduce the heat transfer potential across the interface between the heat generating surface and the heat-dissipating device.

Various materials have been employed in the prior art in an attempt to bridge this interface gap. In particular, organic base materials such as polysiloxane oils or polysiloxane elastomeric rubbers and thermoplastic materials such as PVC, polypropylene, etc. loaded with thermally conducting ceramics or other fillers such as aluminum nitride, boron nitride or zinc oxide have been used to impart thermally conducting properties to the organic base material. In the case of polysiloxane oils loaded with thermally conducting materials, these materials are applied by smearing the heat sink or other electronic component with the thermally conducting paste and then securing the heat sink in place by mechanical means using clips or screws. These prior art, thermal greases show superior film forming and gap filling characteristics between uneven surfaces thus providing an intimate contact between the surface of the heat sink and the surface of the heat-generating source. However, it has been found that the thermal greases exhibit poor adhesion to the surfaces of the heat sink and heat generating surface, thus effectively seeping out from between the heat sink and the heat-generating surface, causing air voids to form between the two surfaces that eventually result in operational hot spots. Moreover, excessive pressure placed upon the heat sink by the mechanical fasteners accelerates this seepage from between the heat sink and the surface of the heat-generating surface. It has been reported that excessive squeeze out of polysiloxane oils can evaporate and recondense on other sensitive parts of the surrounding microcircuits. The recondensed oils lead to the formation of silicates that potentially interfere with the function of the microprocessor, eventually causing failure of the system.

In the case of polysiloxane rubbers and thermoplastic polymers, these materials are typically cast in sheet form and die cut into shapes corresponding to the shape of the heat sink and heat generating device. The resulting preformed sheet is then applied to the surface of the heat-generating surface securing the heat sink by means of clips or screws. The precut films solve the problems associated with greases but do not provide adequate intimate contact required for optimum heat transference between the heat generating source and the heat sink. The added step of cutting preforms and manually applying the pad adds cost to the assembly process. Furthermore, these types of materials show variable performance due to variation in the thickness of the pad and the amount of pressure applied to the thermally conducting precut film, based upon the mechanical device or action used to secure the heat sink. Further, while these known interface materials, are suitable for filling undesirable air gaps, they are generally are less thermally conductive than the heat sink member thus detracting from the overall thermal conductivity of the assembly.

An additional drawback to most of the above noted interface materials is that they require a machined heat sink be secured to a heat generating surface or device using mechanical clips or screws adding to the complexity and assembly time for the overall assembly.

In an attempt to overcome the requirement of mechanical fastening some prior art thermal interface pads are formed of a material that is soft and pliable, having an adhesive on both sides. The pad is first applied under pressure to the mating surface of the heat-dissipating device and the assembly is then pressed onto the heat-generating surface. The pliability of the interface material allows the pad to be compressed into the small grooves and imperfections on the two mating surfaces thus improving the overall performance of the heat transfer through the interface area. The drawback in the prior art is that the use of an adhesive interface pad requires an additional fabrication/assembly step and introduces an additional layer of material along the heat dissipation pathway. Further, as mentioned above, since all of the materials within the assembly are different, optimum heat transfer cannot be achieved.

Therefore, in view of the foregoing, heat transfer assemblies that include interface pads that are formed integrally with the interface contact surface that include a means for mounting the assembly in compression with a heat-generating surface are highly desired. There is also a demand for a heat dissipating assembly for use in an electronic device that is lightweight, has an integral compressible interface pad material and fastening means that can be applied directly to complex geometries for accurate mating of the interface surfaces.

SUMMARY OF THE INVENTION

The present invention provides a new and improved thermal transfer interface having an integrally formed means for fastening and maintaining intimate thermal contact between a heat generating device and a heat dissipating device. The interface of the present invention includes two components, a compressible thermal transfer component having a first thickness and an adhesive fastening component having a second thickness that is less than the first. The first component, the thermal transfer element, includes a base polymer matrix compound that is loaded with a thermally conducting filler that imparts thermally conductive properties to the net shape moldable material. The polymer base matrix is preferably a highly compressible material such as an elastomer. Thermally conductive fillers that would be suitable for use in the present invention include boron nitride, metallic flakes and carbon flakes. The thermal transfer component of the device, being highly compressive, forms an intimate contact between the heat source and the heat sink when installed and held in a compressed state between the heat generating surface and the heat-dissipating surface.

The second component of the present invention is a pressure sensitive adhesive component. The adhesive is applied adjacent to the thermal transfer element and may be located in an alternating pattern throughout a base field of thermal transfer material. The adhesive component has a thickness that is less than the overall thickness of the thermal transfer material. When the heat dissipating device with the present invention applied is pressed into contact with a heat generating surface, pressure must be applied to compress the elastomeric material and allow the adhesive to come into contact with the heat generating surface. Once brought into contact and bonded, the adhesive holds the heat generating and heat dissipating surfaces in firm contact with the preloaded, compressed elastomeric thermal transfer layer therebetween. When the interface of the present invention is installed, the elastomer is compressed until the adhesive makes contact with the mating surface thus increasing the contact pressure between all of the heat transfer surfaces and improving overall thermal conductivity through the entire assembly.

The present invention provides for a complete thermal interface solution and eliminates the requirement for the use of additional clips and fasteners to maintain uniform pressure between the heat generating assembly and the heat dissipating surface as were requires in thermal interfaces of the prior art. The present invention therefore provides a superior interface while simplifying assembly and reducing assembly costs.

It is therefore an object of the present invention to provide a thermal interface assembly that enhances the dissipation of heat from a heat generating electronic component upon which the device is mounted. It is also an object of the present invention to provide a thermal interface assembly for use in an electronic device that is conformable and integrally formed on a heat-dissipating device that provides efficient heat transfer for a heat generating electronic component upon which the device is mounted. It is a further object of the present invention to provide an elastomeric integrally formed conformable thermal interface that includes a means for adhesively fastening the interface in a compressed position, eliminating the need for additional fastening means. It is yet another object of the present invention to provide a heat dissipation assembly as described above that passively provides heat transfer between a heat generating surface and a heat sink while having an integrally formed conformable interface and an integral adhesive that maintains the compression of the interface in order to fill any gaps or voids therebetween. It is a further object of the present invention to provide a conformable elastomeric thermal interface assembly for an electronic device that can be applied directly to complex geometries to accommodate a variety of device shapes.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE INVENTION

Figure 1:
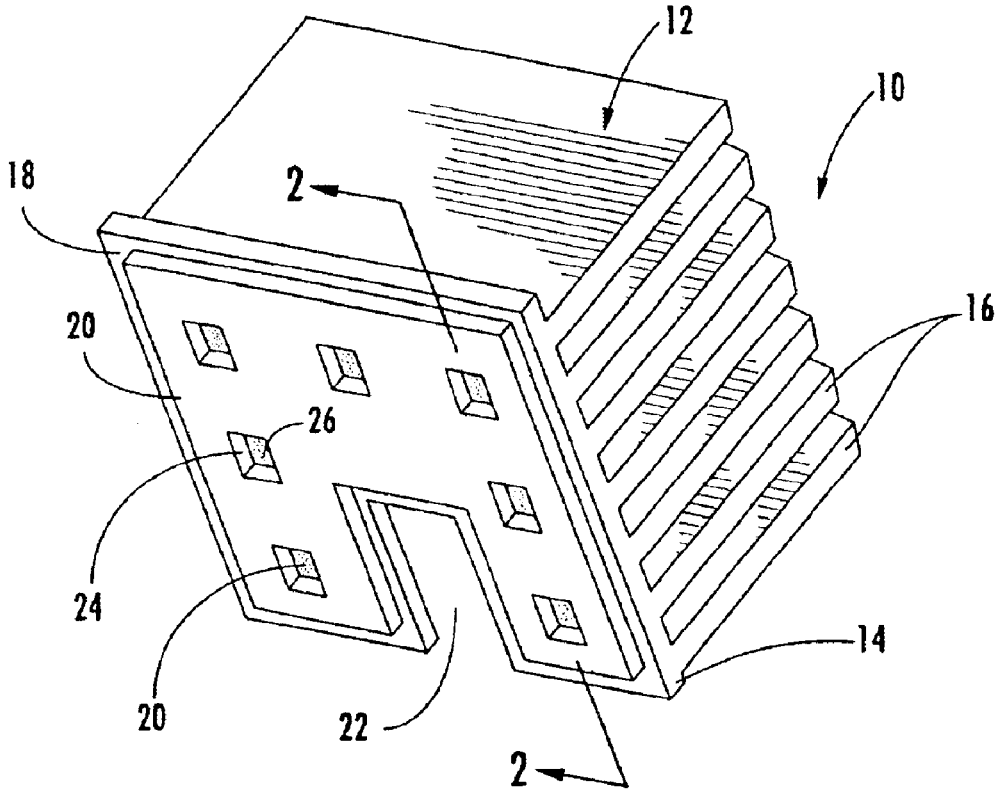
FIG. 1 is a bottom perspective view of the heat dissipation assembly of the present invention.

Referring now to the drawings, the heat dissipation assembly of the present invention is shown and illustrated generally as 10. The present invention is a heat dissipation assembly 10 that includes an integral interface structure and means for retaining the assembly in compressed relation to a heat generating device and a method of manufacturing the same. The assembly of the present invention 10 provides a unique interface structure that includes a compressible thermal interface that is applied to an interface surface of a heat-dissipating device and also includes integral means for retaining the heat dissipation device in operable relation to a heat generating device. The present invention maintains the thermal interface in proper compressed relation with out the requirement of additional fasteners.

Turning now to FIG. 1, the assembly 10 of the present invention is shown here, by way of example, in connection with a traditionally shaped heat sink device 12 having a base element 14, integrally formed surface area enhancements 16 and an interface surface 18 to which the interface composition 20 is applied. While specific structure is used here to illustrate the present invention, it would be understood by one skilled in the relevant art that the disclosure provided herein could be modified to provide any geometry or be applied in any application where heat must be dissipated from a heat-generating device.

The preferred embodiment of the heat dissipating assembly 10 of the present invention is generally shown as described above to include a heat sink 12. Specifically, the heat dissipating assembly 10 includes a heat sink 12 that may be formed from any thermally conductive material such as a metal or polymer material formed from a base polymer matrix loaded with a thermally conductive filler and net shape injection molded into the required geometry. Further, the heat sink 12 may be formed from an aluminum material by milling raw aluminum stock into the required geometry. As can be understood, the heat sink 12 can also be formed by any other suitable method well known in the art. The heat sink 12 includes a base member 14 that is configured in a geometry that provides an interface surface 18 specifically designed to mate with a, heat-generating device in the required application. The specific geometry of the desired application may require that voids 22 such as the one shown in FIG. 1 be provided in the base member 14. The interface surface 18 of the base member 14 provides for mounting the heat sink 12 in mated relationship to the heat-generating surface of a heat generating electronic component.

In order to create proper heat transfer from a heat-generating surface through the interface surface 18 of the heat sink 12, the present invention further provides a compressible interface material 20 that is applied to the interface surface 18 of the heat sink 12. The thermally conductive composition used to make the compressible interface 20 of this invention is formed using an elastomer polymer matrix. Suitable elastomers include, for example, styrene-butadiene copolymer, polychloroprene, nitrile rubber, butyl rubber, polysulfide rubber, ethylene-propylene terpolymers, polysiloxanes, and polyurethanes. The polymer base matrix preferably constitutes 30% to 60% by volume of the total composition. It is important that the base matrix material be an elastomer to provide the interface 20 with a compressible rubber-like consistency, elasticity, and texture. These rubber-like properties, allow the interface 20 to conform to the mating surfaces when placed in compressed relation to create an efficient interface between the heat-generating and heat-dissipating devices as discussed in further detail below.

Thermally conductive filler materials are then added to the polymer matrix. Suitable filler materials include, for example, aluminum, alumina, copper, magnesium, brass, carbon, silicon nitride, aluminum nitride, boron nitride and crushed glass. Mixtures of such fillers are also suitable. The filler material preferably constitutes 25% to 70% by volume of the composition and is more preferably less than 60%. The filler material may be in the form of granular powder, whiskers, fibers, or any other suitable form. The granules can have a variety of structures. For example, the grains can have flake, plate, rice, strand, hexagonal, or spherical-like shapes. The filler material may have a relatively high aspect (length to thickness) ratio of about 10:1 or greater. For example, PITCH-based carbon fiber having an aspect ratio of about 50:1 can be used. Alternatively, the filler material may have a relatively low aspect ratio of about 5:1 or less. For example, boron nitride grains having an aspect ratio of about 4:1 can be used. Preferably, both low aspect and high aspect ratio filler materials are added to the polymer matrix to create a highly efficient thermally conductive composition.

The filler material is intimately mixed with the non-conductive elastomer polymer matrix. The loading of the thermally conductive filler material into the polymer matrix imparts thermal conductivity to the overall composition. Once formed, the mixture is then applied to the desired interface surface 18 of the heat-dissipating device 12 to form the required interface structure 20.

Figure 2:
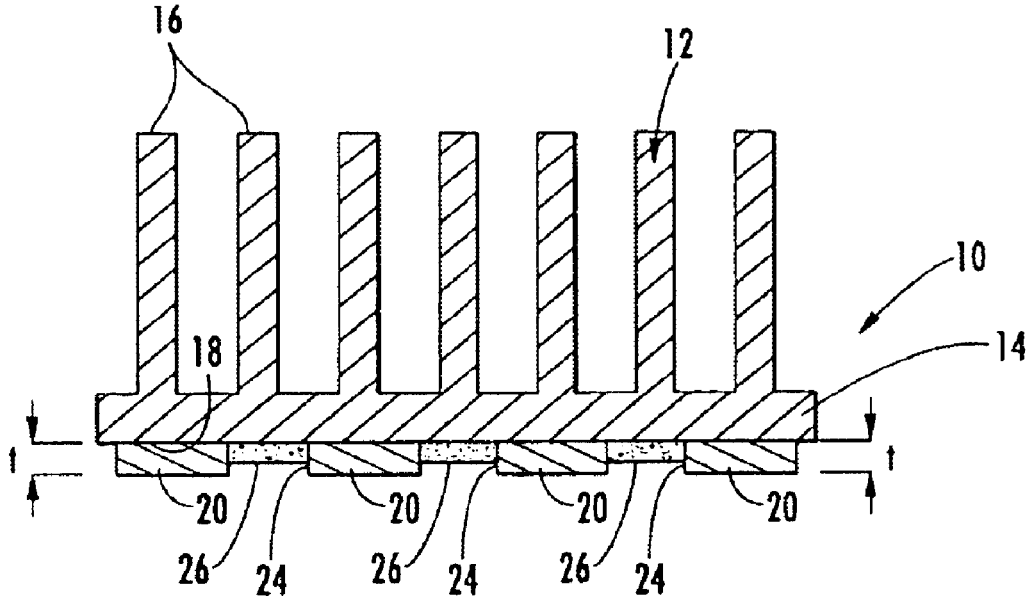
FIG. 2 is a cross-sectional view of the heat dissipation assembly of the present invention through line 2—2 of FIG. 1.

Turning now to FIGS. 1 and 2, the thermally conductive elastomeric composition 20 is shown applied to the interface surface 18 in a predetermined pattern whereby voids 24 are left in the material. These voids 24 are shown as a periodic matrix of square openings in the preferred embodiment but may alternatively be formed as narrow strips extending the length of the interface surface, a matrix of small periodic circles or a void around the entire perimeter of the interface pad. The specific location, geometry, size and configuration of the voids 24 will be calculated and determined by each specific application as required. The composition 20 may be applied to the interface surface 18 using any method known in the art. Preferably, the interface composition 20 will be applied using a screen or stencil printing process where the molten composition is applied directly onto the interface surface 18 and cured in place. By applying the interface composition 20 in this manner, the geometric shape and thickness of the interface composition 20 can be carefully controlled. Through stencil and screen printing methods, the interface composition 20 can be applied to the interface surfaces 18 of heat sinks 12 having complex geometries with a great deal of repeatability and precision. Further, in contrast to the methods in the prior art, only the precise amount of interface composition 20 required to cover the interface surface 18 is applied, greatly reducing waste and eliminating the trimming step required for the removal of excess material. As can be best seen in FIG. 1 the interface material 20 can be placed directly onto the U-shaped interface 18 of the heat sink 12 with out requiring trimming of the excess interface material 20 from the indentation 22 and void 24 areas as would have been required in the prior art. It can be appreciated that the present disclosure is meant only to illustrate the general concepts illustrated herein and not to limit the present invention to any specific geometric configuration.

By applying the interface composition 20 directly onto the interface 18 of the heat sink 12 in a molten state, the composition 20 fills any voids or ridges in the interface surface 18 resulting from the process used in manufacturing the heat sink 12. This provides a more intimate contact between the interface surface 18 and the interface composition 20 and eliminates the requirement of an adhesive layer between the interface 20 and the adjacent surfaces, further lowering the overall thermal resistivity of the assembly and reducing required assembly time.

The voids 24 in the applied interface composition 20 are provided so that adhesive material 26 can be applied directly onto the interface surface 18 of the heat-dissipating device 12. This adhesive 26 is preferably of the pressure sensitive type where in the heat sink 12 can be placed onto the heat-generating surface during final assembly of the components and repositioned if required before pressure is applied, affixing the heat sink 12 into permanent contact with the heat generating surface. If the heat dissipation assembly 10 will be handled or shipped before it is placed onto the heat-generating surface, a layer of removable release paper (not shown) may be provided over the adhesive layer to protect the adhesive 26 from damage or contamination during the intermediate handling or shipping steps. Before final assembly of the heat dissipation assembly 10 onto the heat-generating surface, the release paper is removed, exposing the adhesive layer 26. As can be seen in FIG. 2, the interface composition 20 is applied to a certain thickness (T) and the adhesive 26 is applied to a different thickness (t) that is less than the thickness (T) of the interface composition 20.

As can be best seen in FIG. 2, the use of elastomeric material in combination with this differential thickness is an important feature of the present invention. FIG. 2 is a cross-sectional view of the heat dissipation assembly 10 of the present invention showing the interface composition 20 applied at thickness (T) and the adhesive material 26 applied at thickness (t). For example, the adhesive 26 thickness (t) may for illustration purposes have a thickness of 0.0015 inches where the interface composition 20 may have a thickness (T) of 0.0040 inches.

Figure 3:
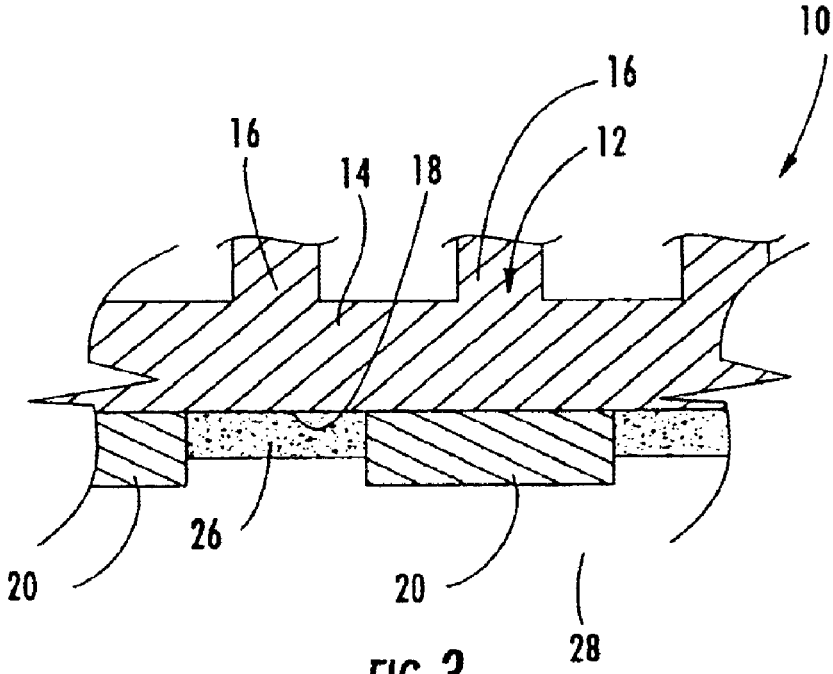
FIG. 3 is a magnified view of the interface portion of the heat dissipation assembly of the present invention in a compressed state.

Turning to FIG. 3, the present invention is shown in cross sectional view applied to a heat-generating surface 28. In application, it can be seen that the present invention when applied to a flat heat-dissipating surface 28 has a differential thickness of 0.0025 inches between the two materials. As the heat dissipation assembly 10 is pressed into contact with the heat dissipation surface 28, the interface composition 20 is compressed by 0.0025 inches forcing the interface composition 20 into intimate contact with the heat-generating surface 28. Once the pressure sensitive adhesive 26 layer contacts the heat-generating surface 28, the heat dissipation assembly 10 becomes permanently affixed thereby maintaining the interface composition 20 in a compressed state. Therefore, when the heat dissipation assembly 10 is pressed into contact with the heat-generating surface 28, the interface composition 20 conforms to the heat-generating surface 28 eliminating the voids and air gaps. The layer of pressure sensitive adhesive 26 cooperates with the conformable interface composition 20 to maintain the interface composition 20 in intimate contact with the heat-generating surface 28 and retaining the interface composition 20 in its compressed state. In this manner, the present invention represents an improvement over the prior art by eliminating the air gaps typically found between a heat generating surface 28 and an interface surface 18 of a heat sink 12, while eliminating the need for providing an additional interface/gap pad. Further, the present invention eliminates the need for additional fasteners or clips to retain the heat dissipation assembly in its operable position.

In view of the foregoing, a superior heat dissipating assembly 10 that eliminates the requirement of additional gap pads or thermal interfaces can be realized. The conformable interface composition 20 and integral adhesive configuration 26 of the present invention, greatly improves over prior art attempts by integrally providing an interface 20 with the ability to bridge and fill the gaps found in typical heat generating surfaces 28 while including integral means for adhering the device in compressed relation with the heat generating surface 28. In particular, the present invention provides an integrated thermal interface with a unitary thermal dissipation assembly that is vastly improved over known assemblies and was until now unavailable in the prior art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermal interface assembly, comprising:

a heat sink device having a substantially planar interface surface, and a heat dissipation surface with surface area enhancements thereon;

a resilient compressible thermal interface material having a first uncompressed thickness, said thermal interface being applied to said interface surface in a predetermined pattern, said pattern having voids therein, wherein said interface material is compressible from said first uncompressed thickness to a second compressed thickness less than said first thickness;

a pressure sensitive adhesive material having a third thickness approximately equal to said second thickness, said adhesive material being applied to said planar interface surface of said heat dissipating device in said voids in said pattern of said thermal interface material; and a heat generating device having a top surface, wherein said heat dissipating device is applied to said top surface with said compressible interface disposed therebetween, said compressible interface being in a compressed state from said first thickness to said second thickness wherein said adhesive material contacts and adheres to said heat generating surface retaining said resilient interface in said compressed state.

2. The thermal interface assembly of claim 1, wherein said compressible thermal interface is an elastomeric polymer loaded with a thermally conductive filler.

3. The thermal interface assembly of claim 2, wherein said thermally conductive filler is selected from the group consisting of carbon fiber, carbon flakes, carbon powder, boron nitride, metallic flakes and crushed glass.

4. The thermal interface assembly of claim 1, wherein said thermal interface material is applied to said interface surface by screen-printing.

5. The thermal interface assembly of claim 1, wherein said thermal interface material is applied to said interface surface by stencil printing.

6. The thermal interface assembly of claim 1, wherein said difference between said first uncompressed thickness and said second compressed thickness is approximately 30% of said first thickness.

7. A thermal interface assembly, comprising:

a heat-dissipating device having a first substantially planar interface surface;

a heat generating device having a second substantially planar interface surface said second interface surface being disposed adjacent to said first interface surface;

a resilient compressible thermal interface material having a first thickness in an uncompressed state and a second thickness in a compressed state, said thermal interface being disposed between said first interface surface and said second interface surface in a predetermined pattern, said pattern having voids therein;

an adhesive material having a third thickness approximately equal to said second thickness, said adhesive material being disposed between said first interface surface and said second interface surface in said voids in said pattern of said thermal interface material, wherein said resillent compressible interface is maintained in said compressed state from said first thickness to said second thickness and retained in said compressed state by said adhesive material.

8. The thermal interface assembly of claim 7, wherein said compressible thermal interface is an elastomeric polymer loaded with a thermally conductive filler.

9. The thermal interface assembly of claim 8, wherein said thermally conductive filler is selected from the group consisting of carbon fiber, carbon flakes, carbon powder, boron nitride, metallic flakes and crushed glass.

10. The heat dissipating device of claim 7, wherein said adhesive material is a pressure sensitive adhesive.

11. A method of manufacturing a heat dissipating assembly, comprising:

providing a base matrix of an elastomer polymer;

loading a thermally conductive filler material into said base matrix to form a mixture;

providing a heat sink device having a first substantially planar interface surface and a second heat dissipating surface, said second heat dissipating surface having surface area enhancements;

applying a first thickness of said mixture to said first interface surface in a predetermined pattern to form a thermal interface, said pattern having voids therein; and applying a second thickness of an adhesive material to said first interface surface in said voids in said pattern, said second thickness being less than said first thickness.

12. The method of manufacturing a heat dissipating assembly of claim 11, wherein said thermally conductive filler is selected from the group consisting of carbon fiber, carbon flakes, carbon powder, boron nitride, metallic flakes and crushed glass.

13. The method of manufacturing a heat dissipating assembly of claim 11, wherein said thermal interface material is applied to said interface surface by screen printing.

14. The method of manufacturing a heat dissipating assembly of claim 11, wherein said thermal interface material is applied to said interface surface by stencil printing.

15. The method of manufacturing a heat dissipating assembly of claim 11, wherein said adhesive material is a pressure sensitive adhesive.

16. The method of manufacturing a heat dissipating assembly of claim 11, further comprising:

providing a heat-generating device having a second interface surface;

placing said first interface surface of said heat dissipating device with said thermal interface and said adhesive material in overlying relation to said second interface surface;

applying pressure to said heat dissipating device, compressing said thermal interface between said first and second interface surfaces from said first uncompressed thickness to third compressed thickness, wherein said adhesive material contacts and adheres to said second interface surface and said thermal interface is and retained in said compressed state by said adhesive material.

17. The method of manufacturing a heat dissipating assembly of claim 16, wherein said difference between said first uncompressed thickness and said second compressed thickness is approximately 30% of said first thickness.

* * * * *